US006817075B1

(12) United States Patent
Kretzschmar

(10) Patent No.: US 6,817,075 B1
(45) Date of Patent: Nov. 16, 2004

(54) DEVICE FOR MOUNTING AND/OR DISMANTLING HOSES ONTO OR FROM CONNECTORS

(76) Inventor: Michael Kretzschmar, Heselstucken 18, D-22453 Hamburg (DE)

( * ) Notice: Subject to any disclaimer, the term of this patent is extended or adjusted under 35 U.S.C. 154(b) by 0 days.

(21) Appl. No.: 09/980,696

(22) PCT Filed: Mar. 29, 2000

(86) PCT No.: PCT/EP00/02736

§ 371 (c)(1),
(2), (4) Date: Apr. 19, 2002

(87) PCT Pub. No.: WO00/64641

PCT Pub. Date: Nov. 2, 2000

(30) Foreign Application Priority Data

Apr. 22, 1999 (DE) ..... 199 18 113

(51) Int. Cl.[7] ..... B25B 27/14

(52) U.S. Cl. ..... 29/272; 29/270; 29/282; 29/261

(58) Field of Search ..... 29/272, 270, 261, 29/255, 263, 252, 280, 282

(56) References Cited

U.S. PATENT DOCUMENTS 4,872,709 A * 10/1989 Stack ..... 285/39
4,893,393 A * 1/1990 Marshall ..... 29/237
6,116,118 A * 9/2000 Wesch, Jr. ..... 81/57.34
6,164,106 A * 12/2000 Nghiem et al. ..... 72/20.1
6,240,626 B1 * 6/2001 Nghiem ..... 29/701
6,434,998 B2 * 8/2002 Amherd ..... 72/416

* cited by examiner

*Primary Examiner*—Lee D. Wilson
(74) *Attorney, Agent, or Firm*—Vidas, Arrett & Steinkraus P.A.

(57) ABSTRACT

An apparatus for mounting and/or dismounting hoses onto or from socket pieces (or operations of such a type) comprising a drive producing a linear driving motion including a power supply unit and a control unit for controlling the driving motion, a feed member adapted to be linearly driven by the drive, pivotally supported inserted plier halves the inner lever ends of which facing away from a socket piece are engaged by the feed member in order to pivot the inserted plier halves with their jaws against a hose disposed therebetween during a forward motion of the feed member, a bearing part supporting the inserted plier halves and adapted to be displaced in the direction of the feed member including a stop, and a counterstop connected to the feed member which, after a phase of the forward motion of the feed member required to clamp the hose in place between the jaws, hits upon the stop ($13^{V}$, $13^{VI}$) while carrying along the bearing part through the remaining phase of the forward motion in order to advance the inserted plier halves and to push the hose clamped therein onto or from a socket piece.

36 Claims, 5 Drawing Sheets

55
55'
2
24'
24''
29'
30'
50
51
52
53
38
36''
34''
40''
9'
9''
13'
13''
13'''
13''''
11'
11''
15
16'
16''
33'
33''
33'''
39''
39'''

DEVICE FOR MOUNTING AND/OR DISMANTLING HOSES ONTO OR FROM CONNECTORS

The invention relates to an apparatus for mounting and/or dismounting hoses onto or from socket pieces, or operations of such a type.

If liquids or gases are to be piped, it is often necessary to fasten hoses to socket pieces. For example, a great variety of hoses are mounted onto socket pieces in a motor vehicle. Mounting a hose onto a socket piece, as a rule, requires to apply considerable force because the hose has an undersized with respect to the socket piece. If the hose is secured to the socket by means of a locking ring or the like it will do to employ a minor undersize and to exert a correspondingly smaller force. However, even if an extra securing element is used a significant expenditure of force can be required if a relatively stiff hose material is employed or the undersize chosen is large with regard to tightness and a safe seating.

In addition, hoses are mounted onto sockets even without an additional securing element with the sealing and securing action solely being caused by the undersize. In such cases, particularly large forces may be required for mounting the hose, specifically if high tightness is required or a relatively stiff hose material is employed. There is such a case, for instance, if the clipless assembly of ventilation hoses is effected on tanks and tank socket pieces.

In some cases, the forces needed can no longer be applied manually, particularly if a multiplicity of identical assemblies have to be done within a certain period.

Other mounting operations causing comparable problems are addressed as well. Generally, the operations concerned are those where an elongate element which is to be mounted and can only be grasped at its outer circumference requires to be forced onto or into a receptacle, specifically if the element to be mounted is flexible or can be buckled.

Similar problems occur if hoses or other elements are to be dismounted.

DE 296 13 654 U1 has made known an apparatus for forcing hose fittings onto hose ends of hose pieces of a large dimensional stability, particularly onto refrigerant hoses, which have at least one accommodating area for inserting a socket piece portion of the hose fitting which is slid onto the hose end of a hose piece wherein the at least one accommodating area is annularly encircled by a plurality of pressing jaws which are movable at least radially inwardly as referred to a central longitudinal axis of the accommodating area to non-positively force the socket piece portion onto the inserted hose end by means of a pressing mechanism. The pressing mechanism has pressurized-medium cylinders which are disposed around the accommodating area in a star-shaped fashion, are aligned radially with respect to the central longitudinal axis of the accommodating, and are designed to be identical, which carry a pressing jaw each and are jointly operable by means of a central pressure control unit.

DE 37 08 245 A1 describes a process and apparatus for mounting hoses, particularly hoses which are flexurally non-rigid, which allow mounting suited for mass production where the mounting time of hoses is low, their dimensions will vary, and there are two or more hose ends. After the first hose end is fixed it is possible to mount the second end or more hose ends freely floating in the space with their connection pieces. To this end, devices exist to provide hose clips and, further, appropriate devices to provide the flexurally non-rigid hoses themselves. To locate the position of the hose ends, there are measuring devices which are fixed to the gripper and monitor the gripping and joining operation by measuring the existence of the hose, the gripper force, the position of the gripping jaws, the joining path, and the slippage of the hose in the gripper and correcting them via appropriate regulating devices.

DE 94 21 475 U1 relates to a mounting aid for connecting the parts of a hose coupling, i.e. a sleeve-like hose coupling element having an open hose end, to a locking device to hold the open hose end in place, on one side, and a retaining device to hold in place the hose coupling element to be inserted into the hose end, on the other, and a positioning device which is apt to displace the retaining and locking devices with respect to each other in such a way that the hose coupling element can be forced into the open hose end. The mounting aid is characterized in that a basic body of the mounting aid has a rigid connection to the locking device to hold the hose end in place and the positioning device has a feed rod which carries the slidably guided retaining device with the basic body having a handle against which a feed lever can be pulled to advance the feed rod.

Therefore, it is the object of the invention to provide an apparatus which makes it easier to mount and/or dismount hoses onto or from socket pieces and to carry out operations of this type.

The object is achieved by an apparatus having the features of claim 1. Advantageous aspects of the apparatus are indicated in the sub-claims.

The inventive apparatus for mounting and/or dismounting hoses onto or from socket pieces, or for operations of such a type has

- a drive producing a linear driving motion including a power supply unit and a control unit for controlling the driving motion,
- a forward feed member adapted to be linearly driven by the drive,
- pivotally supported inserted plier halves the inner lever ends of which facing away from a socket piece are engaged by the feed member in order to pivot the inserted plier halves with their jaws against a hose disposed therebetween during a forward motion of the feed member,
- a bearing part supporting the inserted plier halves and adapted to be displaced in the direction of the feed member including a stop, and
- a counterstop connected to the feed member which, after a phase of the forward motion of the feed member required to clamp the hose in place between the jaws, hits upon the stop while carrying along the bearing part through the remaining phase of the forward motion in order to advance the inserted plier halves and to push the hose clamped therein onto or from a socket piece.

The inventive apparatus makes it possible to mount and dismount hoses onto and from socket pieces in a simple and safe way. For this purpose, it utilizes a plier-like tool which uses forced control so that it clamps the hose in place between jaws in a first operation phase in such a way that it cannot be displaced therebetween by the forces which occur, and which pushes the thus clamped hose onto or from the socket piece only in a second operation phase. To achieve this, the forced control has a feed member which, in a first phase of an forward motion, merely controls the closing motion of the inserted plier halves and, in a second phase of a forward motion, causes the hose to be pushed on or off via stops which become active. This apparatus can be advantageously designed as a hand-held instrument which can be employed in mounting and dismounting operations in a particularly flexible way.

Especially if designed as a hand-held instrument, the apparatus can be provided with an end support for being stayed on a socket piece and/or a structure carrying the socket piece and/or a structure having a stable position with respect to the socket piece, which absorbs the reaction forces produced by pushing the hose onto the socket.

Preferably, the drive has at least one driving piston which is connected to a pressurized-medium connection via a pressurized-medium valve. The forward motion of the feed member is initiated by applying compressed air to the driving piston. In principle, the backward motion can be caused by routing the compressed air over to another surface of the driving pistons. Preferably, however, the drive has a spring mechanism for moving back the driving pistons in case of pressure relief. Pressurized-medium controlled drive constructions of this type are known, in particular, from the field of pressurized-medium actuated pliers for locking rings, etc., and are described, for example, in DE 195 19 543 C2.

The inserted plier halves may be pushed by another spring mechanism into an initial position where the inserted plier halves are pivoted away from each other.

Basically, the apparatus may be designed in two types: On one hand, the forward motion of the feed member is directed away from the drive in order to force the hose onto a socket piece remote from the drive. The jaws are then disposed between the drive and any end support. On the other hand, the forward motion of the feed member may be directed towards the drive in order to pull the hose onto a socket piece located near the drive. An end support will then be disposed between the drive and the jaws of the inserted plier halves. Which design to choose will depend on which possible accesses to the socket piece exist.

The two types described for the forward motion can also be utilized in dismounting hoses from socket pieces. In such a case, however, the jaws and end supports will have to exchange the aforementioned positions.

As is known from the field of pressurized-medium operated pliers the feed member may have chamfers which interact with the inner lever ends. Moreover, for a reduction of frictional forces, the inner lever ends may carry rotatably supported rollers the circumference of which is engaged by the feed member.

It is preferred that the inserted plier halves are designed substantially of a Z shape with a first outer leg of the Z shape, which disposes them pivotally in a plane containing the axis of motion of the feed member, and a second outer leg of the Z shape which forms the jaw disposing them in a second plane in parallel with the first one. This allows to lead the hose in the second plane past those parts of the apparatus which support, drive, or control the pliers.

To safely clamp the hose, the inserted plier halves each preferably have a partially cylindrical receptacle. The two receptacles are preferably provided with an undersize with regard to the cross-section of the hose to be accommodated and/or with respect to a nozzle at the end of the hose. Such a nozzle makes it easier to push the hose onto the socket piece.

Moreover, the jaws can have locking surfaces which are rigid in a first portion which is at front in the direction of forward motion, and are elastic in a second portion which is at rear in the direction of forward motion. The rigid portion serves to safely grip the hose. The elastic portion is intended to allow the hose to be guided and to be expanded while being pushed over the socket piece. It may be formed from an elastic insert of the respective locking surface. This prevents the hose from buckling under the large forces that act while the hose is being pushed on.

According to an advantageous further aspect, the bearing part has two parallel-arranged slide blocks which are guided in slide-block guides and are interconnected by bolts. The inserted plier halves can be supported on them between the slide blocks. Preferably, the slide blocks are of a panel shape.

The stop may be formed by the end of at least one elongated hole of the bearing part which is directed towards the axis of motion of the feed member and the counterstop can be formed by a dog pin which is disposed transversely to the axis of motion in the feed member and traverses the elongated hole. Such an elongated hole may be formed in each one of the parallel slide blocks and either of the elongated holes may be gripped through by the dog pin.

Preferably, the bearing part is associated with a detent which after the hose is clamped between the jaws is releasable by a further forward motion of the feed member. This helps achieve a safe separation of the closing motion of the inserted plier halves for safely gripping the hose prior to their forward motion to push the hose onto or from the socket. Preferably, the detent has at least one arresting body which, when in an arresting position, partly engages an receptacle of the bearing part and partly engages a counter-receptacle and, when in a release position, only continues to engage the counter-receptacle. It can be forced into the arresting position by means of a spring. It is understood that the counter-receptacle has a fixed position within the apparatus.

In principle, the arresting device may be caused to be released by the counterstop hitting onto the stop and, as a result, the feed member carrying along the bearing part. In contrast, according to an advantageous further aspect, the arresting body is adapted to be moved out of its receptacle in the bearing part by a release of the feed member. The release can have at least one surface inclined obliquely to the feed axis for moving an arresting body into the counter-receptacle from its receptacle in the bearing part.

Preferably, the apparatus has a casing comprising the drive. A tool head carrying the inserted plier halves can be disposed on a casing. An end support may be fixed to the tool head and/or the casing. Further, a control section having the control unit device and/or the power supply unit may be disposed on the casing.

The invention will now be explained in more detail with reference to the accompanying drawings of two embodiments. In the drawings.

In the description of various embodiments which follows, like reference numbers are used for elements which are identical or at least coincide to a large extent.

Figure 1:
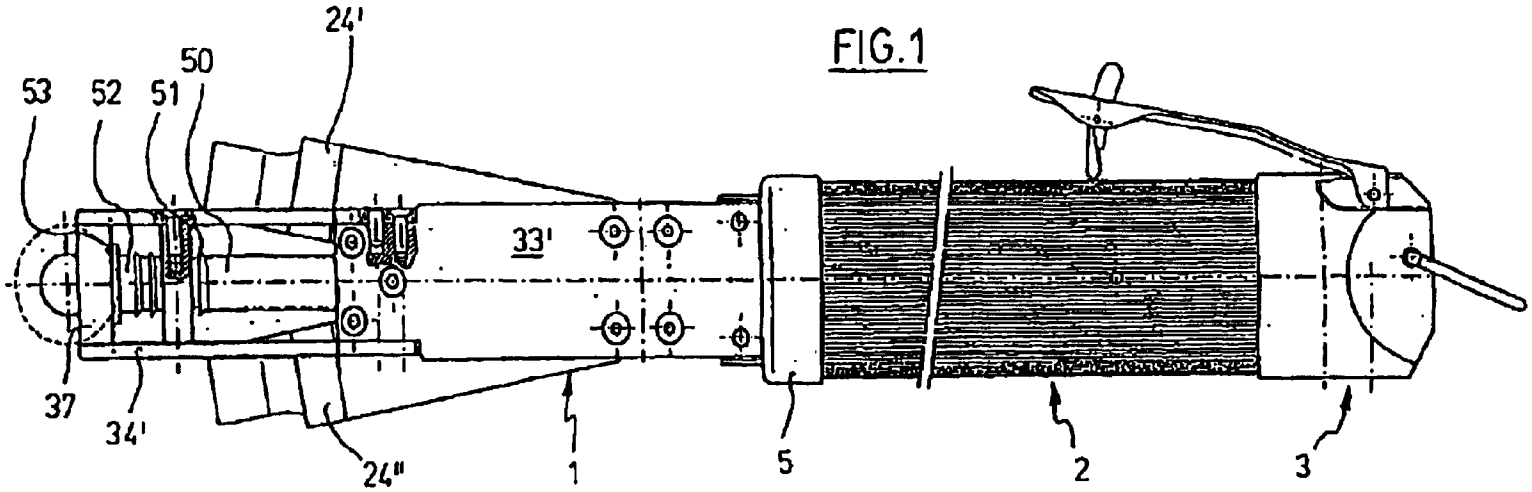
FIG. 1 shows an apparatus for forcing a hose onto a socket piece with the inserted plier halves pivoted away from each other in a plan view.
Figure 4:
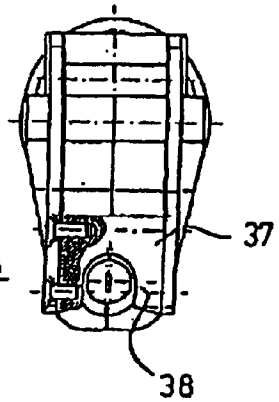
FIG. 4 shows the same apparatus in a front view with some elements partially broken away.
Figure 2:
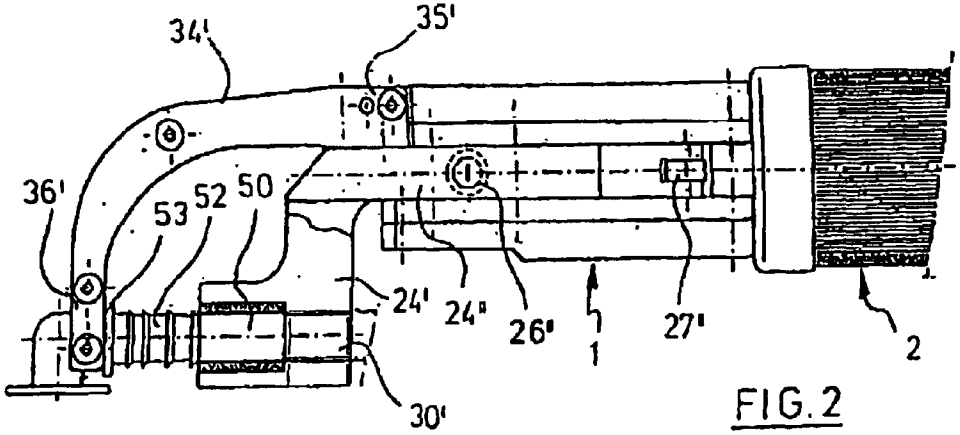
FIG. 2 shows the front portion of the same apparatus in a side view which partly is a longitudinal section.

Some terms which are repeatedly used in the course of the description denote what follows:

"Inside": the position of lever ends of the inserted plier halves with regard to the socket piece, the sides of the covering panels and side panels as well as a border of the carrying ring with regard to the central axis of the feed member.

"Outside": the position of sides or parts of the slide blocks, side panels, inserted plier halves or the direction of displacement of the arresting pins as referred to their central axis or the position of one side of the parting walls as referred to their central axis.

"Forward": the direction of motion of the feed member into the inserted plier halves and the axial motion thus caused for the inserted plier halves.

"Advance": the displacement of the inserted plier halves which is caused by the penetration of the feed member.

The various devices substantially have three portions: a tool head 1, a drive 2, and a control unit 3.

The tool head 1 has a carrying ring 4 which is gripped over by a fastening ring 5 on a flange and is bolted to one end of a cylindrical casing 6 which houses the drive 2. An upper side panel 9' and a lower side panel 9" are mounted on the carrying ring 4 by means of pins 8', 8" in parallel with and at a spacing from each other. Slide-block guides 10', 10" are worked into the oppositely facing sides of the side panels 9', 9". In the vicinity of the carrying ring 4, the guides each have a starting portion of a smaller width which passes over into a widened portion approximately in the middle of the side panels 9' 9" via a rounded transition area.

On the axis of the slide-block guide 10', 10", the two side panels 9', 9" have formed therein elongate passage holes 11', 11" which extend in the narrower portion of the slide-block guide 10', 10". Further, the two side panels 9', 9" have formed therein more elongate passage holes 12', 12" symmetric to the axis of the slide-block guide 10', 10", which are disposed in the wider portion of the slide-block guide.

In the slide-block guides 10', 10", panel-shaped slide blocks 13', 13" are slidably disposed each a stalk-shaped portion of which is guided each in the narrow portion and a widened portion of which is guided each in the wide portion of the slide-block guide 10', 10".

In their wider portion, the slide blocks 13', 13" have bores aligned to each other in which bearing pins 14', 14" are seated that are passed through the elongate passage holes 12', 12" of the two side panels 9', 9" and connect the slide blocks 13', 13" to each other. The bearing bolts 14', 14" are secured to the outsides of the slide blocks 13', 13" through a head and a retaining ring.

Moreover, in their stalk-shaped portion on the axes of the slide-block guides 10', 10", the slide blocks 13', 13" have elongated holes 13""; 13$^{IV}$ which are aligned to each other and through which a single dog pin 15 is passed and traverses the elongate passage apertures 11', 11". Between a head of the dog pin 15 and the upper slide block 13' and a retaining ring of the dog pin 15 and the lower slide block 13", panel-shaped releases 16', 16" are fixed each which are provided, at their front, with symmetric chamfers 17', 17" symmetric with the axis of the slide blocks 10', 10".

Pins 14', 14", and 15 hold the slide blocks 13', 13" together such that they are caught in the slide-block guides 10', 10", but can be slid therein.

The outer surfaces of the side panels 9', 9" have worked therein two oval receptacles 18', 18" each in parallel and symmetrical with the axes of the slide-block guides 10', 10". The receptacles seat a spiral spring 19', 19" each which is formed from a slightly bent spring wire having ends bent into eyelets. The spiral springs 19', 19" are associated with the narrower portions of the slide-block guides 10', 10".

Small guide grooves 18', 18" which connect the receptacles 18', 18" to the slide-block guides 10', 10" are worked into the side panels 9', 9" approximately in the center of receptacles 18', 18". The slide-block guides 10', 10" are worked into the side panels 9', 9" to a larger depth than are the receptacles 18', 18". The grooves 20', 20" are of the same depth as are the slide-block guides 10', 10".

Figures 3, 5, 6:
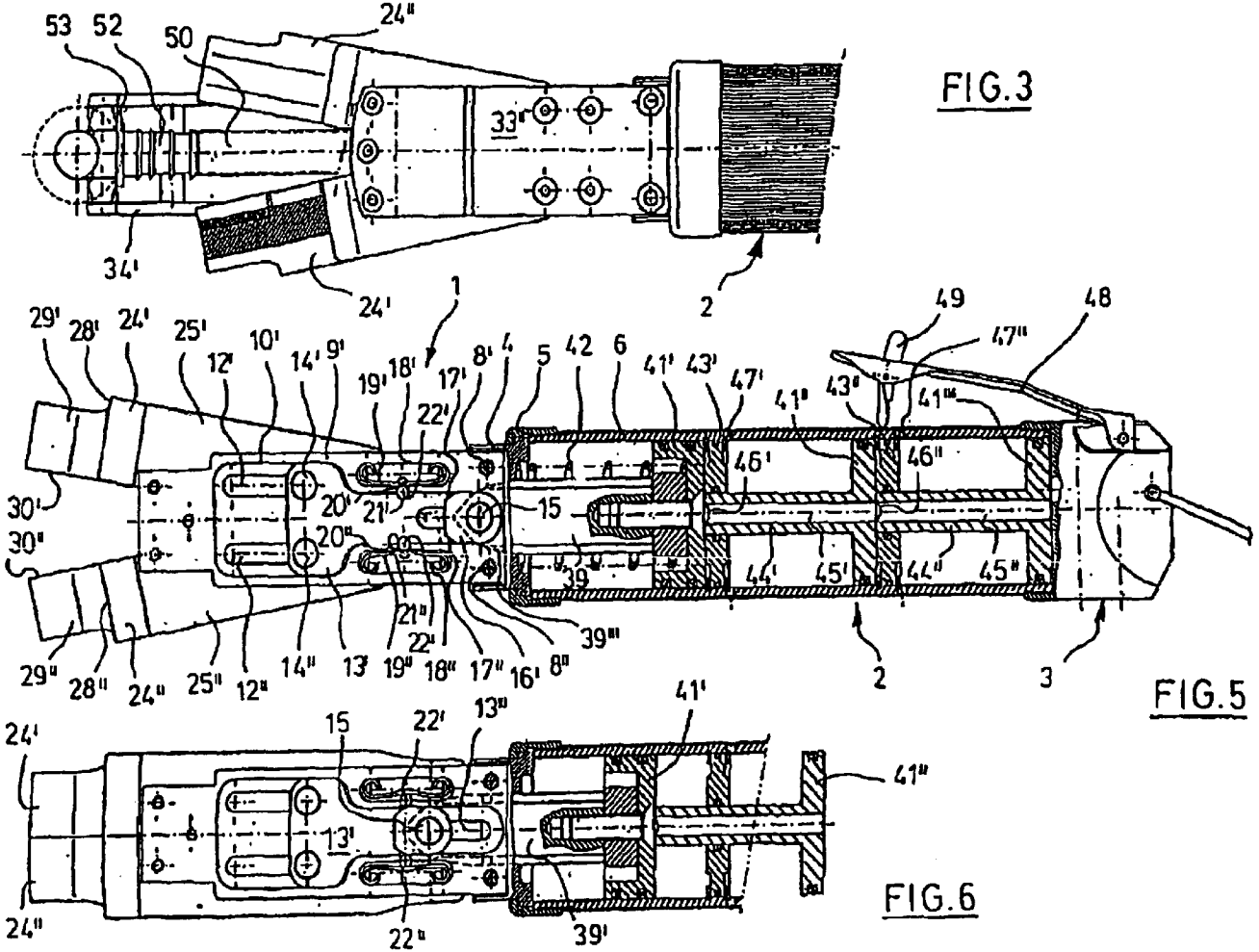
FIG. 3 shows the front portion of the same apparatus in a bottom view which partly is a longitudinal section.
FIG. 5 shows the same apparatus in a horizontal longitudinal section.
FIG. 6 shows the front portion of the same apparatus with the inserted plier halves pivoted together in a horizontal longitudinal section.
Figure 9:
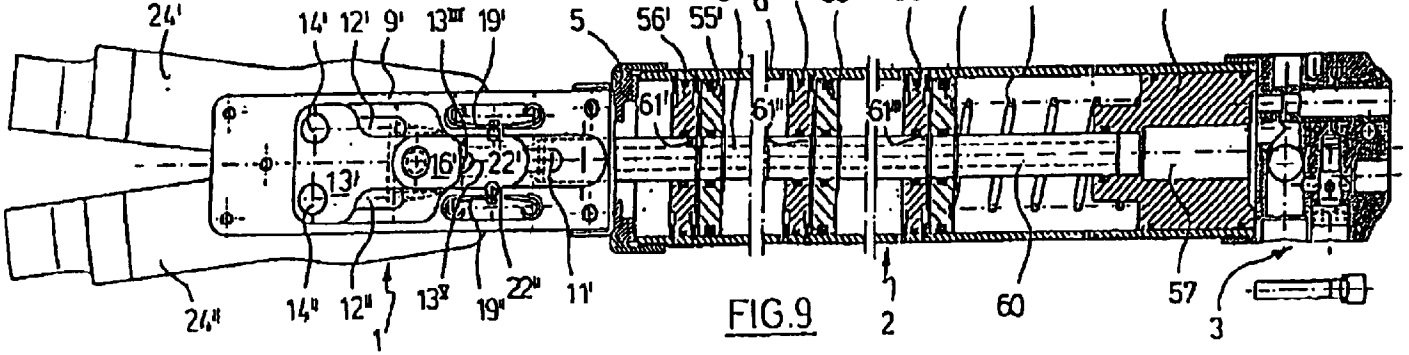
FIG. 9 shows the apparatus for mounting a hose onto a socket piece with the inserted plier halves pivoted away from each other in a longitudinal section.

Two partially cylindrical receptacles 21', 21" each are worked into the stalk-shaped portions of the slide blocks 13', 13". In the positions of FIG. 5 and FIG. 9, the receptacles 21', 21" seat small cylindrical arresting pins 22', 22" which, at the same time, engage the grooves 20', 20" which form counter-receptacles. The arresting pins 22', 22" are forced into these positions by the spiral springs 19', 19". However, the arresting pins 22', 22" can be completely forced into the counter-receptacles 20', 20" against the action of the spiral springs 19', 19". This can be accomplished by displacing the releases 16', 16" along the axes of the slide-block guides 10', 10". The reason is that the chamfers 17', 17" urge the arresting pins 22', 22" outwardly during this action.

Figure 8:
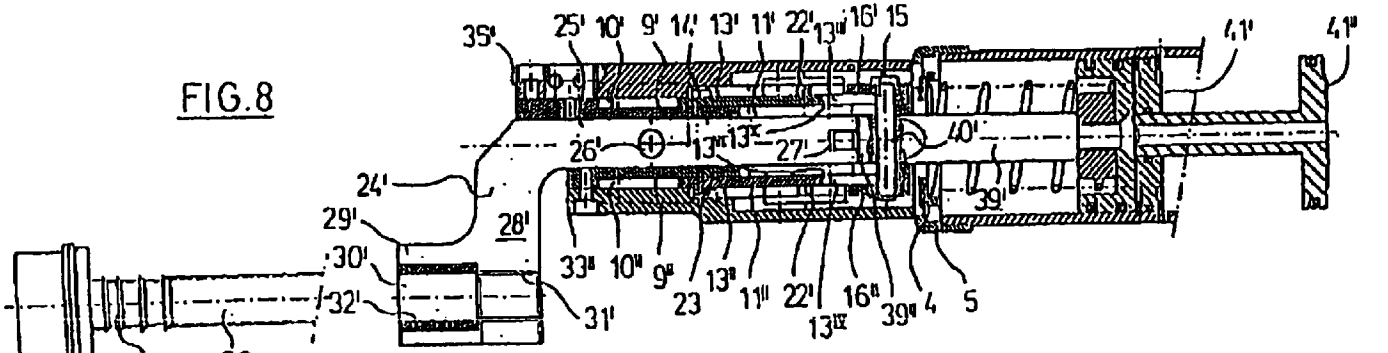
FIG. 8 shows the front portion of the same apparatus with the inserted plier halves pivoted away from each other (but projected into the plane of the drawing) in a vertical longitudinal section.

The slide-block guides 13', 13" which are held together by the pins 14', 14", and 15 define a bearing part 23 for two inserted plier halves 24', 24". Those are substantially of a Z shape each (cf. FIGS. 8 and 12). They cause a first outer leg 25', 25" to engage the gap between the two side panels 9', 9" each. In these outer legs 25', 25", they have a bearing eye each by which they are pivotably supported each on one of the two bearing pins 14', 14". The two first outer legs 25', 25" have pocket bores 26', 26" facing each other which seat a helical spring which tries to pivot the inserted plier halves 24', 24" away from each other.

The inner lever ends, i.e. those closer to the carrying ring 24, of the inserted plier halves 24', 24" and the first outer legs 25" are each fitted with a rotatably supported roll 27', 27".

Second outer legs 29', 29" which form jaws are connected to the first side legs 25', 25" via intermediate legs 28', 29". The jaws 29', 29" have cylindrical receptacles 30', 30" at the sides facing each other. The receptacles 30', 30" each have a rigid portion 31', 31" formed integrally with the inserted plier halves 24', 24", with a roughened surface and an elastic portion 32', 32" which is formed by an inserted sleeve segment made of rubber (Shore hardness 40).

If not otherwise specified, a steel of a suitable quality is preferably employed for the aforementioned parts. This essentially applies to the remaining components of the apparatus as well unless these are sealing elements.

Moreover, the tool head 1 has an upper cover panel 33' and a lower cover panel 33" which can be made of aluminum. The cover panels 33', 33" are bolted to the side panels 9', 9" and, via the pins 8', 8", to the carrying ring 4 in various points.

At the insides, the cover panels 33', 33" have receptacles (not designated in detail by reference numbers) for the heads and washers of the pins 14', 14", 15 for those portions of the arresting pins 22', 22" which protrude beyond the side panels 9', 9", and for the releases 16', 16". The configuration of the receptacles is such as to allow for a displacement of the aforementioned parts as far as is required. To this end, receptacles 33''', 33$^{IV}$ cause the releases 16', 16" to be guided laterally.

In the embodiment of FIGS. 1 through 8, the upper cover panel 33' also serves as a carrier for an end support 34' which is bolted thereto. This one has the shape of a 90° arc with its fixed end 35' and its free end 36' enclosing an angle of 90°. The free end of the end support 34', between side portions thereof, fixes a panel 37 which has a receptacle 38 which is open towards the free end. The receptacle 38 is coaxially aligned with the receptacles 30', 30" of the inserted plier halves 24', 24".

In the embodiment of FIGS. 9 through 12, an end support 34" is bolted to the lower cover panel 33". The end support 34" has the shape of a 90° angle. Its leg 36" which sticks out also has a receptacle 38 formed therein which is open towards the free end of the end support 34". The receptacle 38 also is coaxially aligned with the receptacles 30', 30" of the inserted plier halves 24", 24".

Thus, in the embodiment of FIGS. 1 through 8, the jaws 29', 29" of the inserted plier halves are disposed between the free end 36' to be located of the end support 34' and the drive 2. In contrast, in the embodiment of FIGS. 9 through 12, the free end 36" to be located of the end support 34" is positioned between the jaws 29', 29" of the inserted plier halves 24' and the drive 2.

The drive 2 of the two embodiments has a feed member 39', 39" at front which protrudes into the region between the side panels 9', 9" from the casing 6 and the carrying ring 4. At the front end, the feed member 39' has chamfers 39''' which are symmetrical to its central axis, i.e. it essentially is shaped like a wedge. At this point, the chamfers 39''' define a major wedge angle at the very front and a minor wedge angle behind it. The chamfers 39''' are formed only at the sides of the feed member 39'. At top and bottom, the feed member 39' is guided at the insides of the side panels 9', 9".

The dog pin 15 is passed through a bore 40' of the feed member 39' so as to be movable with the feed member.

The feed member 39" has a chamfer 39$^{IV}$ which is circumferentially symmetrical between a throat and an end-positioned thickened area. The end-positioned thickened area has a bore 40" through which the dog pin 15 extends so as to be movable with the feed member 39".

The drives 2 have pistons which are disposed in a successively staggered relationship in a cylindrical cavity of the casing 6.

In the embodiment of FIGS. 1 through 8, this incorporates a pot-shaped driving piston 41' which is fixed to the rear end of the feed member 39' by means of a screw. A helical restoring spring 42 surrounds the feed member 39' and is supported at the bottom of the driving piston 41' at one end and on an inner border of the carrying ring 4 at the other end. It is anxious to force the driving piston 41' away from the tool head 1. The restoring spring 42 is capable of displacing the driving piston 41', as a maximum, up to an annular disk-shaped parting wall 43' which is sealingly fixed in the casing 6 at the outside. When the piston 41' has been advanced up to the carrying ring 4 the restoring spring 42 is protected from excessive compression in receptacles of the piston 41' and the carrying ring 4.

The casing 6 sealingly fixes another annular disk-shaped parting wall 43" at a spacing from the parting wall 43' at the outside.

Shanks 44', 44" of T-shaped driving pistons 41", 41''' are sealingly guided in the central openings of the annular disk-shaped parting walls 43', 43".

All of the driving pistons 41', 41", 41''' are slidably and displaceably guided in the casing at their outer circumference.

When the driving piston 41' is pushed back by the restoring spring 42 it urges the driving piston 41" against the parting wall 43" and the latter urges the driving piston 41''' against the bottom of the control unit 3.

Moreover, the driving pistons 41', 41''' are provided with central, axially directed through bores 45', 45" which communicate with recesses 46', 46" at the ends of the shafts 44', 44" which rest on adjacent driving pistons.

The driving piston 41 ' is aerated by the tool head 1 on the side facing the feed member 39'. On the side of the shanks 44', 44", the driving pistons 41", 41''' have associated therewith aeration bores 47', 47", which traverse the wall of the casing 6 next to the parting walls 43', 43".

The control unit 3 forms a hood-shaped closure of the casing 6. The side of the control unit 3 pivotally supports a release lever 48 which laterally extends across some portion of the length of the casing 6. The release lever 48 is urged by a spring, which is not shown, into the position drawn from the side of the casing 6. It may be secured therein by means of a lever 49 which is supported on the jacket of the casing 6 in a securing position.

The control unit 3 has a connection for compressed air, which is not shown. It also includes a control unit, which is not shown either, with valve facilities. As a result, pivoting the release lever 48 towards the casing 6 makes it possible to apply compressed air to that side of the driving pistons 41', 41", 41''' which faces the control casing and to connect it to the environment by relieving the pressure of the release lever 48.

This apparatus operates as follows:

Initially, a hose 50 with an end which is flared to form a nozzle 51 is placed onto a socket piece 52 which is designed as an angular socket piece here. The socket piece 52 has an annular disk-shaped lug 53. Then, the apparatus is placed over the hose 50 with the inserted plier halves opened and is placed onto the socket piece 52 behind the stop 53 along with the receptacle 38 of the end support 34'.

Compressed air is applied to the driving pistons 41', 41", 41''' by actuating the release lever 48, during which operation the compressed air passes onto the driving pistons 41" and 41' through the through bores 45", 45' and the recesses 46", 46'. As a result, all of the driving pistons 41', 41", 41''' are displaced towards the tool head 1 with the feed member 39' sliding its chamfers 39'''' across the rollers 27', 27" of the inserted plier halves 24' and pivoting these to each other until the jaws 29', 29" come to lie together and clamp the hose 50 in place. This situation is shown in FIG. 6.

When the feed member 39' continues to be advanced the releases 16', 16" which are moved along urge the arresting pins 21', 21" away from each other so that the bearing part 23 may be moved with respect to the side panels 9', 9". At the same time, the dog pin 15 which forms a counterstop hits onto the end 13$^{V}$, 13$^{VI}$ of the elongated holes 13''', 13$^{IV}$, which forms a stop, while carrying along the bearing part 23.

Figure 7:
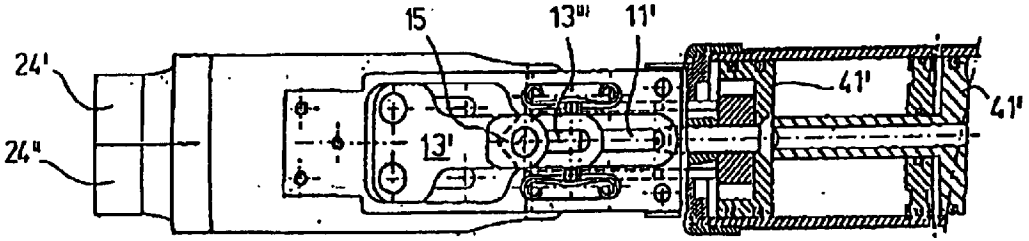
FIG. 7 shows the front portion of the same apparatus with the inserted plier halves advanced in a horizontal longitudinal section.

As a result, the inserted plier halves 24', 24" which are supported thereon are advanced up to the position shown in FIG. 7.

While the inserted plier halves are advanced the hose 50 which is clamped therebetween is pushed onto the socket piece 52. This flares the elastic portion 32', 32" of the receptacles 30', 30" in order to make room for the hose 50 to be flared by the socket piece 52.

In the embodiment of FIGS. 9 through 12, the feed member 39" is connected to a piston rod 54 extending through the fill length of the casing 6. Fixed thereto in a spaced relationship are disk-shaped driving pistons 55', 55", 55'" which are sealed towards the casing 6 at the outer circumference, but are axially displaceable with respect thereto.

The piston rod 54 is sealingly passed through disk-shaped parting walls 56', 56", 56'" which are fixed at the outer circumference in the casing 6 and are sealed thereto. In addition, the piston rod 54 is sealingly guided, at the end remote from the tool head 1, in a through bore 57 of a plug-like structural part 58 which is inserted into the casing 6 and is sealingly retained there at the circumference. A restoring spring 59 is disposed between the driving piston 55'" and the plug-like structural part 58 so that it tries to displace the driving pistons 55', 55", 55'" towards the tool head until they come to bear on the parting walls 56', 56", 56'".

The piston rod 54 is traversed by an axial pocket bore 60 which opens into the through bore 57 and extends beyond the driving piston 55'. The pocket bore 60 is connected to the cavity of the casing 6 via radial through bores 61', 61", 61'" on that side of the driving pistons 55', 55", 55'" which is associated with the tool head 1. Through bores 62', 62", 62'" traverse the wall of the casing 6 next to the parting walls 56', 56", 56'".

The hood-shaped control unit 3 closes the casing 6 and is connected to a release lever 48, not shown, the actuation of which causes compressed air to be fed to the through bore 57 and the pressure relief of which causes the through bore 57 to be connected to the atmosphere.

This apparatus operates as follows:

Initially, a hose 50 having a bordered 51 end is pushed onto a socket piece 52. Then, the apparatus is placed over the end of the hose 50 with the inserted plier halves 24', 24" opened and is placed over a portion of the socket piece 52 behind a disk-shaped lug 53 thereof. This situation is illustrated in FIGS. 9 and 12.

Figures 10, 11, 12:
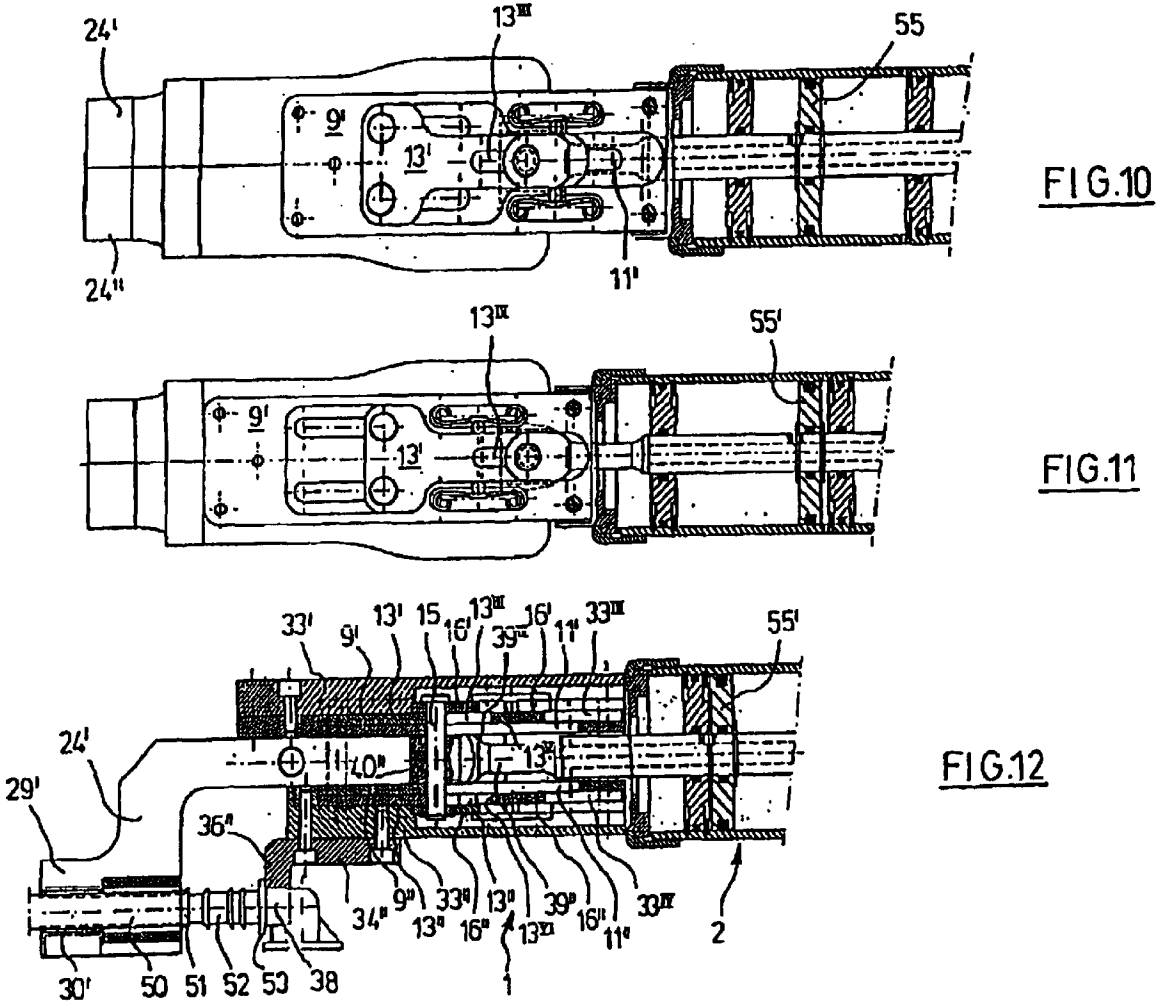
FIG. 10 shows the front portion of the same apparatus with the inserted plier halves pivoted together in a longitudinal section.
FIG. 11 shows the front portion of the same apparatus with the inserted plier halves retracted in a longitudinal section.
FIG. 12 shows the front portion of the same apparatus with the inserted plier halves pivoted away from each other (but projected into the plane of the drawing) in a vertical longitudinal section.

After this, the release lever 48 is actuated, the result of which is that the inserted plier halves 24', 24" are closed and clamp the hose 50 in place as is shown in FIG. 10. The reason is that the pistons are acted on by the compressed air through the through bores 60 and 61', 61", 61'" in such a way that the feed member 39" is pulled towards the drive 2 while using the chamfer $39^{IV}$ to pivot the inserted plier halves 24', 24" to each other on the roller which are not shown.

When the feed member 39" continues to be advanced the releases 16', 16" urge the arresting pins 22', 22" outwardly, and the dog pin 15 hits onto the end $13^{V}$, $13^{VI}$ of the elongated holes 13'", $13^{IV}$, which causes the bearing part 23 formed by the slide blocks 13', 13" and the bearing pins 14', 14" to be carried along by the feed member 39". As a result, the inserted plier halves 24', 24" are pulled towards the drive and the hose 50 clamped in place is pulled onto the socket 52. At this point, the elastic portions 32', 32" of the receptacles 30', 30" get slightly flared again.

The two devices are removed from the hose 50 and the socket 52 first by letting go the release lever 48, which causes the driving pistons 41', 41", 41'" and 55', 55", 55'" to be acted on by the atmosphere and to be moved back by the restoring springs 42 and 59, respectively, to their initial positions as is shown in FIG. 5 and FIG. 9, respectively. At the same time, the inserted plier halves 24', 24" are pivoted away from each other by the spring disposed therebetween so that the apparatus can be removed from the object mounted.

Figure 13:
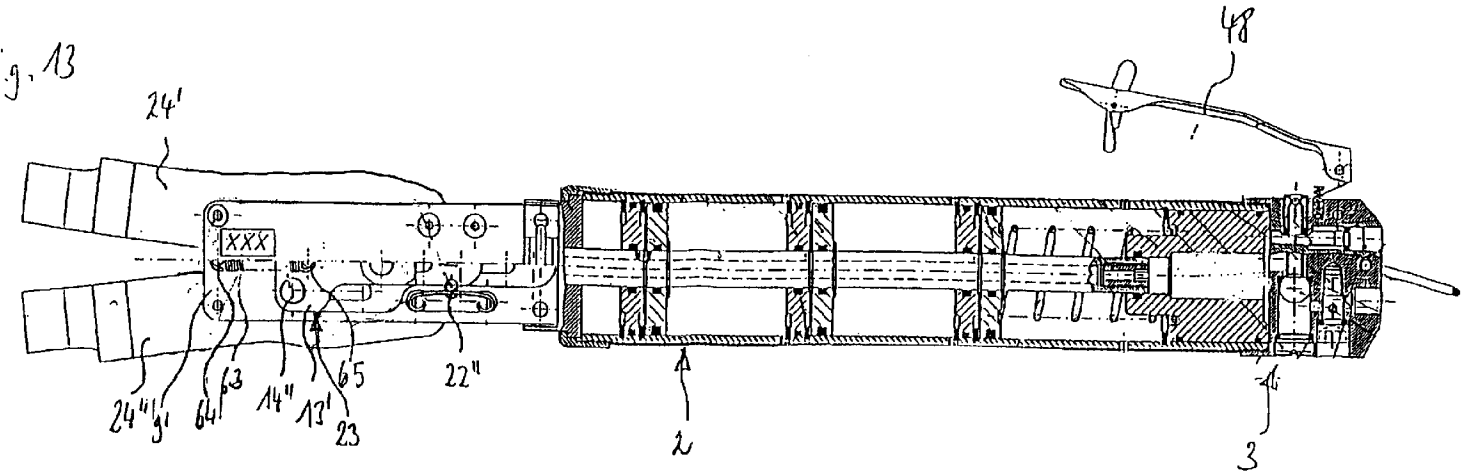
FIG. 13 shows another apparatus for mounting a hose onto a socket piece with the inserted plier halves pivoted away from each other in a longitudinal section.
Figure 14:
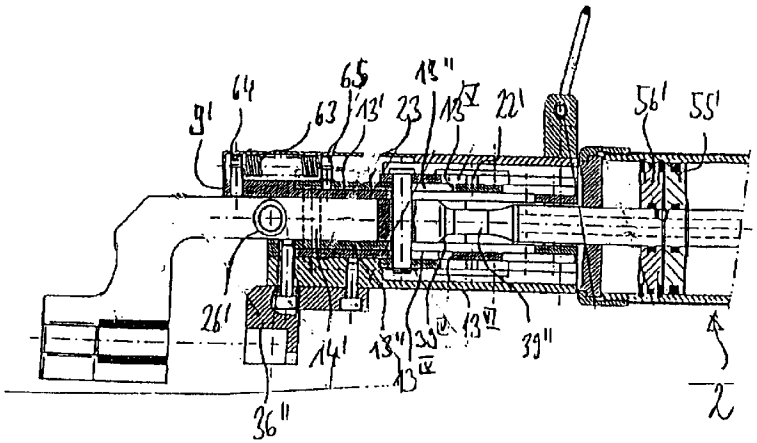
FIG. 14 shows the front portion of the same apparatus with the inserted plier halves pivoted away from each other (but projected into the plane of the drawing) in a vertical longitudinal section.

In the embodiment of FIGS. 13 and 14, a tension spring 63 which is designed as a helical tension spring in the example is disposed between the upper side panel 9' and the slide block 13', as a difference from the previously described embodiment. The spring is held on pins 64, 65 which project from the upper sides of the side panel 9' and the slide block 13', respectively, by means of end-sided eyelets. Hence, the tension spring 63 is tensioned between the upper side panel 9' located with respect to the casing and the slide block 13', which slide block 13' , along with the slide block 13" and the bearing pins 14', 14" interconnecting the blocks, supports the inserted plier halves 24', 24.

The situation preceding the actuation of the release lever 48 is shown in FIGS. 13 and 14. The tension spring 63 either is relaxed or is slightly pre-loaded in this situation.

As in the embodiment of FIG. 9 through 12, an actuation of the release lever 48 causes the feed member 39" to pivot the inserted plier halves 24', 24" to each other on the rollers by means of the chamfer 24', 24". At this point, the tension spring 63 provides for the bearing part 23 to remain in the position of FIGS. 13 and 14. Thus, the tension spring 63 provides for the rollers to permanently bear on the inner lever ends of the inserted plier halves 24', 24" on the chamfer $39^{IV}$ of the feed member 39". In addition, the tension spring, together with the arresting pins 22', 22", prevents the bearing part 23 from being carried along by the feed member 39" before the inserted plier halves 24', 24" have closed around the end of a hose and hold it in place.

Not until the releases 16', 16" force the arresting pins 22', 22" outwardly and the dog pin 15 hits onto the stop-forming ends $13^{V}$, $13^{VI}$ of the elongated holes 13"" , $13^{IV}$ while the feed member 39" continues to be advanced the bearing part 23, under a tension of the tension spring 63, will be carried along by the feed member 39". The result is that the inserted plier halves 24', 24" are pulled towards the drive 2 and a hose clamped in place is pulled onto a socket piece.

After the release lever 48 is let off the feed member 39" returns to the initial position which is illustrated whereby the dog pin 15 hits against the other ends of the 13"", $13^{IV}$ while carrying along the slide blocks 13', 13" and, hence, the inserted plier halves 24', 24" in the opposite direction. This is supported by the helical tension spring 63. The inserted plier halves 24', 24" are pivoted away from each other by the action of the spring which is disposed between them.

What is claimed is:

1. An apparatus for mounting hoses onto socket pieces comprising:

a drive (2) producing a linear driving motion including a power supply unit and a control unit (3) for controlling the driving motion, a feed member (39) constructed and arranged to be linearly driven by the drive (2), pivotally supported inserted plier halves (24) the inner lever ends (27) of which facing away from a socket piece (52) are engaged by the feed member (39) in order to pivot the inserted plier halves (24) with their jaws (29) against a hose (50) disposed therebetween during a forward motion of the feed member (39), a bearing part (23) supporting the inserted plier halves (24) and constructed and arranged to be displaced in the direction of the feed member including a stop ($13^{V}$, $13^{VI}$), and a counterstop (15) connected to the feed member (39) which, after a phase of the forward motion of the feed member (39) required to clamp the hose (50) in place between the jaws (29), hits upon the stop ($13^V$, $13^{VI}$) while carrying along the bearing part (23) through the remaining phase of the forward motion in order to advance the inserted plier halves (24) and to push the hose (50) clamped therein onto or from a socket piece (52).

2. The apparatus according to claim 1, including an end support (34) for being stayed on a socket piece (52) and for absorbing the reaction forces produced by pushing the hose (50) onto the socket piece (52).

3. The apparatus according to claim 1 wherein the drive (2) has at least one driving piston (41, 55) which is connected to a pressurized-medium connection via a pressurized-medium valve.

4. The apparatus according to claim 3 wherein the drive has a spring mechanism (42, 59) for moving back the driving pistons (41, 55) in case of pressure relief.

5. The apparatus according to claim 1 wherein there is another spring mechanism between the inserted plier halves (24) for pivoting then inserted plier halves (24) away from each other.

6. The apparatus according to claim 1 wherein the forward motion of the feed member (39) is directed away from the drive (2).

7. The apparatus according to claim 6 wherein the inserted plier halves (24) with their jaws (19) are disposed between the drive (2) and the end support (34').

8. The apparatus according to claim 1 wherein the forward motion of the feed member (39) is directed towards the drive (2).

9. The apparatus according to claim 8 wherein the end support (34') is disposed between the drive (2) and the jaws (29) of the inserted plier halves (24).

10. The apparatus according to claim 1 wherein the feed member (39) has chamfers (39) which interact with the inner lever ends (27).

11. The apparatus according to claim 1 wherein the inner lever ends carry rotatably supported rollers (27) the circumference of which is engaged by the feed member (39).

12. The apparatus according to claim 1 wherein the inserted plier halves (24) each are substantially of a Z shape, each of them being pivotally disposed, with a first outer leg (25), in a plane containing the axis of motion of the feed member (39) and, with a second outer leg (29) forming one jaw, are disposed in a second plane parallel with the first one.

13. The apparatus according to claim 1 wherein the jaws (29) of the inserted plier halves (24) each form a partially cylindrical receptacle (30) for a portion of the hose (50).

14. The apparatus according to claim 13 when the receptacles (30) of the jaws. (29) have an undersize with regard to the cross-section of the hose (50) to be accommodated.

15. The apparatus according to claim 13 wherein the jaws (29) have locking surfaces (30) for clamping the hose (50) in place, which are rigid in a portion (31) which is farther way from the end support (34) and are elastic in a portion (32) which is closer to the end support (34) for pushing a clamped hose (50) over and onto a hose nozzle (52).

16. The apparatus according to claim 15 wherein the rigid portion (32) of the locking surges (30), along with the inserted plier halves (24), is integrally formed on rigid material.

17. The apparatus according to claim 16 wherein the elastic portion (52) of the locking surfaces (30) is formed by sleeve segments introduced into the jaws (29).

18. The apparatus according to claim 1 wherein the jaws on the locking surfaces (30) have a structure that enhance friction.

19. The apparatus according to claim 1 wherein the bearing part (23) has two parallel-arranged slide blocks (13) which are guided in slide block guides (10) and are interconnected by bolts (14, 15) on which the inserted plier halves (24) are supported between the slide blocks (13).

20. The apparatus according to claim 19 wherein the slide blocks (13) are of a panel shape.

21. The apparatus according to claim 1 wherein the stop ($13^V$, $13^{VI}$) is formed by the end of at least one elongated hole ($13^V$, $13^{VI}$) of the bearing pot (23) which is directed towards the axis of motion of the feed member (39) and the counterstop is formed by a dog pin (15) which is disposed transversely to the axis of motion in the feed member and traverses the elongated hole.

22. The apparatus according to claim 1 wherein the bearing part (23) is associated with a detent (19 to 22) which after the hose (50) is clamped in place between the jaws (29) is releasable by a further advance of the feed member (39).

23. The apparatus according to claim 22 wherein the detent (19 to 22) has at least one arresting body (22) which, when in an arresting position, partly engages an receptacle (21) of the bearing part (23) and partly engages a counter-receptacle (20) and, when in a release position, only continues to engage the counter-receptacle (20).

24. The apparatus according to claim 23 wherein the arresting body is a cylindrical arresting pin (22) which when arrested, by a partial cross-section engages a partially cylindrical receptacle (21) of the bearing part (23) and by a partial cross-section engages a groove (20) as a counter-receptacle which is capable of accommodating the fall cross-section of the arresting pin (22).

25. The apparatus according to claim 23 wherein the arresting body (22) is forced by a spring (19) into the arresting position.

26. The apparatus according to claim 23 wherein the spring is a spiral sprig (19).

27. The apparatus according to claim 23 wherein the arresting body (22) is constructed and arranged to be moved out of its receptacle (21) in the bearing part (23) by means of a release (16) of the feed member (39).

28. The apparatus according to claim 27 wherein the release (16) has at least one spice (17) inclined obliquely to the forward feed axis for moving an arresting body (22) into the counter-receptacle (20) from its receptacle (21) in the bearing part (23).

29. The apparatus according to claim 1 wherein the arresting body (22) is disposed on either side of the feed axis.

30. The apparatus according to claim 23 wherein the two slide blocks (13) are associated with arresting bodies (22).

31. The apparatus according to claim 1 wherein the end support (34) has a bent-away fork head, a panel with a laterally opened receptacle (38) for gripping behind a lug (53).

32. The apparatus according to claim 1 which has a casing (6) comprising the drive (2).

33. The apparatus according to claim 1 which has a tool head (1) carrying the inserted plier halves (24) on a casing (6).

34. The apparatus according to claim 1 wherein the end support (34) is fixed to the tool head (1).

35. The apparatus according to claim 1 which has a control section including the control unit (3).

36. The apparatus according to claim 1 which is designed as a hand-held instrument.

* * * * *